US005360675A

United States Patent [19]

Wood et al.

[11] Patent Number: 5,360,675

[45] Date of Patent: Nov. 1, 1994

[54] MOLTEN ZINC RESISTANT ALLOY AND ITS MANUFACTURING METHOD

[75] Inventors: John C. Wood; Shoichi Katoh; Hideo Nitta, all of Saitama, Japan

[73] Assignee: Praxair S.T. Technology, Inc., Danbury, Conn.

[21] Appl. No.: 59,857

[22] Filed: May 11, 1993

[30] Foreign Application Priority Data

May 14, 1992 [JP] Japan ..... 4-148211
Aug. 26, 1992 [JP] Japan ..... 4-250630

[51] Int. Cl.[5] ..... C03C 27/02; B32B 15/04

[52] U.S. Cl. ..... 428/631; 428/663; 428/937; 428/630; 420/429; 148/423

[58] Field of Search ..... 428/681, 663, 630, 631, 428/632, 633, 937; 148/423; 420/429

[56] References Cited

U.S. PATENT DOCUMENTS

| | | | |
|---|---|---|---|
| 3,025,182 | 3/1962 | Schrewelius | 420/429 |
| 3,091,548 | 5/1963 | Dillon II | 428/937 |
| 3,690,686 | 9/1972 | Prasse et al. | 428/663 |
| 3,749,559 | 7/1973 | Prasse | 428/663 |
| 4,645,715 | 2/1987 | Ovshinsky et al. | 428/469 |
| 4,822,415 | 4/1989 | Dorfman et al. | 75/251 |

FOREIGN PATENT DOCUMENTS

| | | |
|---|---|---|
| 56-112447 | 9/1981 | Japan . |
| 1108335 | 4/1989 | Japan . |
| 1225761 | 9/1989 | Japan . |
| 2236266 | 9/1990 | Japan . |
| 0394048 | 7/1991 | Japan . |

*Primary Examiner*—Richard O. Dean
*Assistant Examiner*—Sean Vincent
*Attorney, Agent, or Firm*—Cornelius F. O'Brien

[57] ABSTRACT

An alloy of 3 to 9 weight percent boron with the balance molybdenum for use as a thermal spray coating for articles intended to be exposed to molten zinc.

4 Claims, 2 Drawing Sheets

Fig. 1
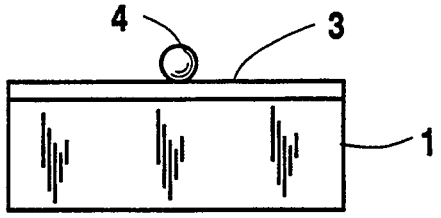
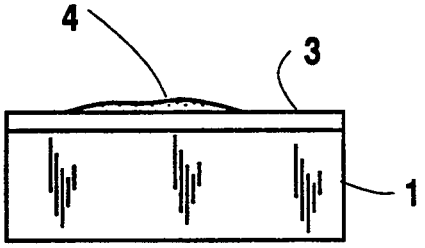
Fig. 2
(PRIOR ART)
Fig. 3
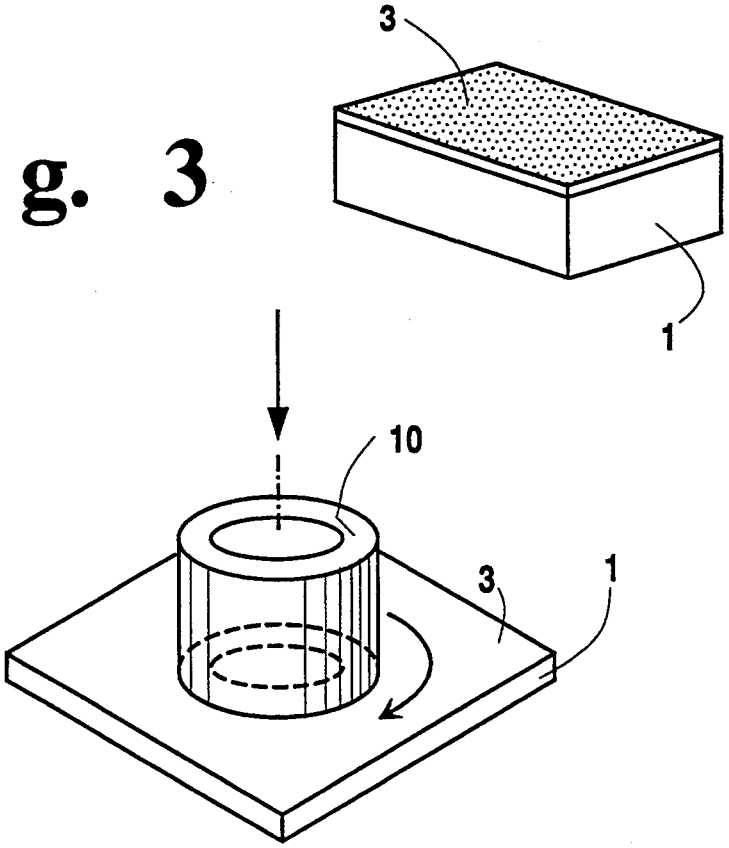
Fig. 6

MOLTEN ZINC RESISTANT ALLOY AND ITS MANUFACTURING METHOD

FIELD OF THE INVENTION

This invention relates to a Mo-B alloy which has excellent resistance to attack by molten zinc and wear resistance and to its manufacturing method and its use, specially relates to a component coated with this alloy for use in a molten zinc bath used for a hot-dip zinc plating line and which will contact the molten zinc.

PRIOR ART

Molten zinc can easily penetrate into micro gaps with the size of micrometer order, as it has low viscosity and low surface tension. Besides it is very corrosive for metal.

For example stainless steel such as SCH-22 is generally used as a material of a pot roll for a hot-dip zinc plating line for steel strip. Therefore the pot roll is severely attacked by molten zinc itself and the precipitated ternary intermetallic compounds being comprised of aluminum, iron and zinc damages the surface of the roll in a short term. Aluminum is an additive of the zinc bath and iron is liquated from steel strip and the roll into the bath. The damaged roll surface causes defects on the steel strip resulting in poor quality of the strip.

To prevent metal made components from attack by molten zinc or to inhibit the formation of the intermetallic compounds on the components, the following technologies have been proposed.

(1) Improvement of materials of the component.

(2) Thermal sprayed and fused layers of self-fluxing alloys.

(3) Thermal sprayed or built-up cermet coatings.

BRIEF DESCRIPTION OF THE DRAWINGS

FIG. 1 shows the sketch of test result for the specimen relative to the present invention.

FIG. 2 shows the sketch of test results for the specimen relative to the prior arts.

FIG. 3 shows the oblique projection of the specimen used for the reaction test between coatings and zinc.

FIG. 6 schematically shows the method of the wear test.

(Symbols in the Drawings)

Figure 4:
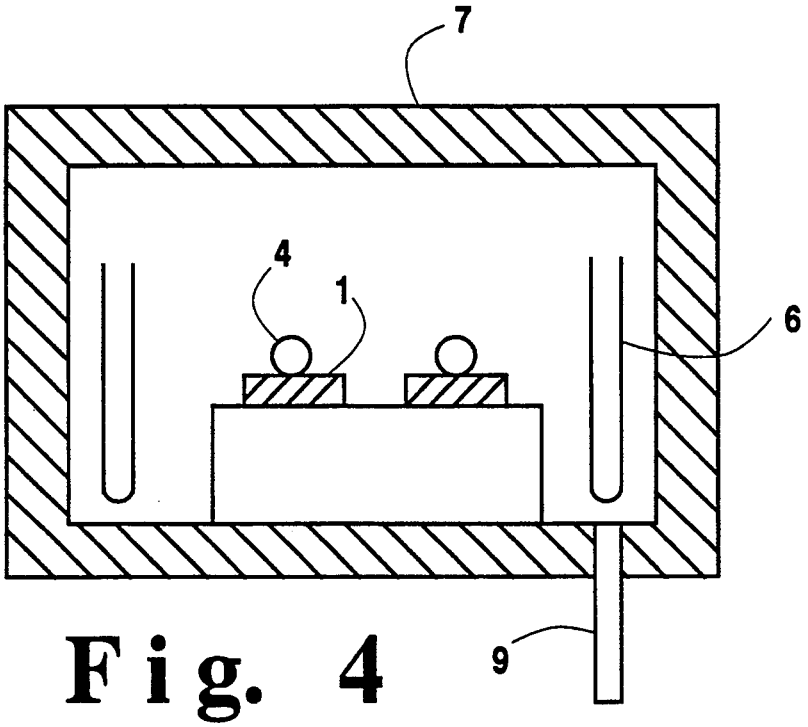
FIG. 4 schematically shows the equipment used for the reaction test between coatings and zinc.

1. Plate-type specimen
2. Bar-type specimen
3. Coated layer (coating)
4. Zinc grain zinc droplet
5. Molten zinc molten zinc bath
6. Heater
7. Furnace
8. Graphite pot
9. Nitrogen gas inlet
10. Ring

DETAILED DESCRIPTION OF THE INVENTION

The component made of an iron alloy is disclosed in Japanese Patent laid-open No. S56-112447 but it does not have sufficient corrosion resistance as a molten zinc immersed component.

As disclosed in Japanese patent laid-open No. H1-108335, the component on which surface is thermal sprayed with Co, Ni or Fe base self-fluxing alloy and fused to form a dense and corrosion resistant layer is proposed. This improves corrosion resistance of the component to some extent and is practically used frequently in the field, however, the corrosion resistance is not enough because the component is basically made of a metal alloy.

A component with cermet coatings has been mentioned with alloys or mixtures of metal of carbides or borides. For instance, a component with a thermal sprayed cermet coating being comprised of WC-Co combination, a component with a thermal sprayed cermet coating being comprised of metal and a metal boride or a metal carbide and a component with a thermal built-up layer being comprised of cobalt and borides or carbides are disclosed in Japanese Patents laid open No. H1-225761, No. H2-236266 and No. H3-94048 respectively. In these coatings metal components such as cobalt, boride and carbide are basically excellent corrosion resistance coatings but do not work effectively in molten zinc.

The addition of a metal, such as cobalt or the like, as a binder is necessary for the above mentioned coatings. Because it has been very difficult to form a layer dense enough to prevent zinc penetration with coatings comprised of only borides and carbides by thermal spray methods which are used for surface treatment for relatively large component, such as components in a hot-dip zinc plating bath, since such borides and carbides have high melting point, over 2000° C., and are brittle while they are superior corrosion resistance.

The aim of the present invention is to proposed a new alloy which is easily formed as the above said coating and its manufacturing method to produce an excellent corrosion and wear resistant component which can be immersed in or contacted with molten zinc, that has a dense coated layer of the said alloy on the surface to prevent zinc penetration as well as to avoid precipitation of the intermetallic compounds comprising aluminum from additive of the bath, iron to be liquated from the steel base metal, and zinc, the main compound of the bath, on the surface of the layer and to propose the manufacturing method of the component.

As a results of studying various protective coatings, it was unexpectedly found that Mo-B alloy containing 3 to 9 wt % or favorably 6 to 8 wt % boron and the balance molybdenum has an excellent resistance to molten zinc attack and wear resistance and has a high suitability for forming a thermally sprayed layer. Besides the said alloy showed the properties suitable for the above said purpose in preferable when at least a part of the boride in the alloy exists as MoB or $Mo_2B$.

The alloy of this invention can be coated by detonation and gas flame spraying processes under a weak oxidizing atmosphere with MoB as a starting powder or by plasma spraying process with the Mo-B alloy as a starting powder and that it can be directly coated on the surface of a metal made component as a thermal sprayed layer.

In addition, superior properties for the coating can be achieved by putting sealing on the said coating with a non organic sealing material such as water glass or colloidal silica.

The Mo-B alloy containing the prescribed boron becomes a cermet alloy in which intermetalic compounds such as MoB and $Mo_2B$ in a molybdenum matrix are precipitated as the content of boron increases. The hardness of the precipitated phases are very high and it contributes to higher hardness and wear resistance of the alloy.

For example in a coating formed by detonation spraying process with MoB as a starting powder, MoB and $Mo_2B$ can be appropriately precipitate in the matrix alloy by selecting optimum gas conditions as for example, oxidizing conditions. The coating produced is ideally suited for uses which require wear resistance and resistance to molten zinc attack at the same time such as in a pot roll.

It was observed that the best way of forming the dense Mo-B alloy coating with porosity of less than 1% would be to use detonation thermal spraying process in which acetylene and oxygen gases are used.

That is to say the inventors solved the problem by developing the following components and methods.

(1) A molten zinc resistant alloy comprising 3 to 9 wt % or favorably 6–8 wt % boron and the balance molybdenum with impurities.

(2) A molten zinc resistant alloy in which at least a part of boron exists as the form of MoB, $Mo_2B$ or MoB and $MO_2B$.

(3) An alloy for a thermally spayed coating applied on the surface of a component intended to be immersed in molten zinc, said alloy comprising 3 to 9 wt % or favorably 6–8 wt % boron and the balance molybdenum with normal impurities.

(4) A process to form a thermal sprayed coating on a surface of a metallic component for use in a molten zinc bath, comprising 3 to 9 wt % or favorably 6 to 8 wt % boron and the balance molybdenum with normal impurities, coated by detonation and gas flame spraying process under a weak oxidizing atmosphere in which sufficient oxygen should exist to cause the reaction necessary to produce the desired coating with MoB as a starting material.

(5) A process to form a molten zinc resistant thermal sprayed coating on the surface of a metal made molten zinc immersed component, comprising 3 to 9 wt % or favorably 6 to 8 wt % boron and the balance molybdenum with normal impurities, coated by plasma process with a starting material of Mo-B alloy which contains 3 to 9 wt % boron and normal impurities.

(6) A process to form a molten zinc resistant thermal sprayed coating, comprising 3 to 9 wt % favorably 6 to 8 wt % boron and the balance molybdenum with normal impurities, coated by detonation and gas flame spraying process under a weak oxidizing atmosphere in which sufficient oxygen should exist to cause the reaction necessary to produce the desired coating with MoB as a starting material.

(7) An article with excellent resistance to the attack by molten zinc and wear resistance when immersed in or contacted with molten zinc, having a coated layer on its surface made of Mo-B alloy containing 3 to 9 wt % or favorably 6 to 8 wt % boron.

(8) The above article described in (7) which at least a part of the said boron exists as the form of MoB or $Mo_2B$.

(9) The above article described in (7) or (8) in which the said coated layer is formed by a thermally sprayed coating.

(10) The above article described in (9) in which the said coated layer is sealed with a non organic sealing material such as water glass or colloidal silica.

(11) A manufacturing method for producing a component which is immersed in or contacted with molten zinc with consist of forming a thermally sprayed layer on its surface by detonation and gas flame spraying process under the weak oxidizing atmosphere with MoB as a starting powder.

(12) A manufacturing method for producing a component which is immersed in or contacted with molten zinc with consist of forming a thermally sprayed layer on its surface by plasma spraying process with a starting material of Mo-B alloy which contains 3 to 9 wt % boron and normal impurities.

It is to be understood that an alloy containing 3 to 9 wt % boron with the balance molybdenum shall also mean the normal impurity found in this type of alloy. The reason why the content of boron in Mo-B alloy coating formed on a component is limited within 3 to 9 wt % is that if the contents is less than 3% MoB and $Mo_2B$ to be precipitated in the molybdenum matrix is not enough to make the alloy wear and corrosion resistant, while if the content is increased beyond 9%, those properties are flattened and porosity starts to increase. The preferred contents of boron is from 6 to 8 wt % as determined was by experiments.

EMBODIMENT-1

FIG. 1 and FIG. 2 shows the sketch of results of a test which evaluates the reaction between the coating and zinc relative to the components of the prior arts or of this invention. FIG. 3 and FIG. 4 show the oblique projection of the specimen for the test and the sketch of test equipment, respectively.

The grain of zinc (4) was placed on one side of the stainless steel (SUS 403) made plate-type specimen (1) shown in FIG. 3 (30×30×10 mm) which has a coated Mo-B layer sprayed by the detonation process, heated by the heater (6) in the furnace (7) with nitrogen atmosphere made up by nitrogen gas provide through the inlet hole (9) up to 500° C. which is higher than the melting point of zinc and kept for five hours.

Zinc grain did not wet to the specimen with the coating (3) and kept its droplet configuration as show in FIG. 1. In addition, there was no evidence observed to indicate reaction between zinc and the coating.

EXAMPLE 1 FOR COMPARISON

The reaction between a coating and zinc was observed on a specimen coated with WC-CO which was tested in the same testing condition described in "Embodiment 1" for a comparison and the wetting angle estimated by the configuration of zinc droplet shown in FIG. 2 was 20 degree.

EMBODIMENT-2

Figure 5:
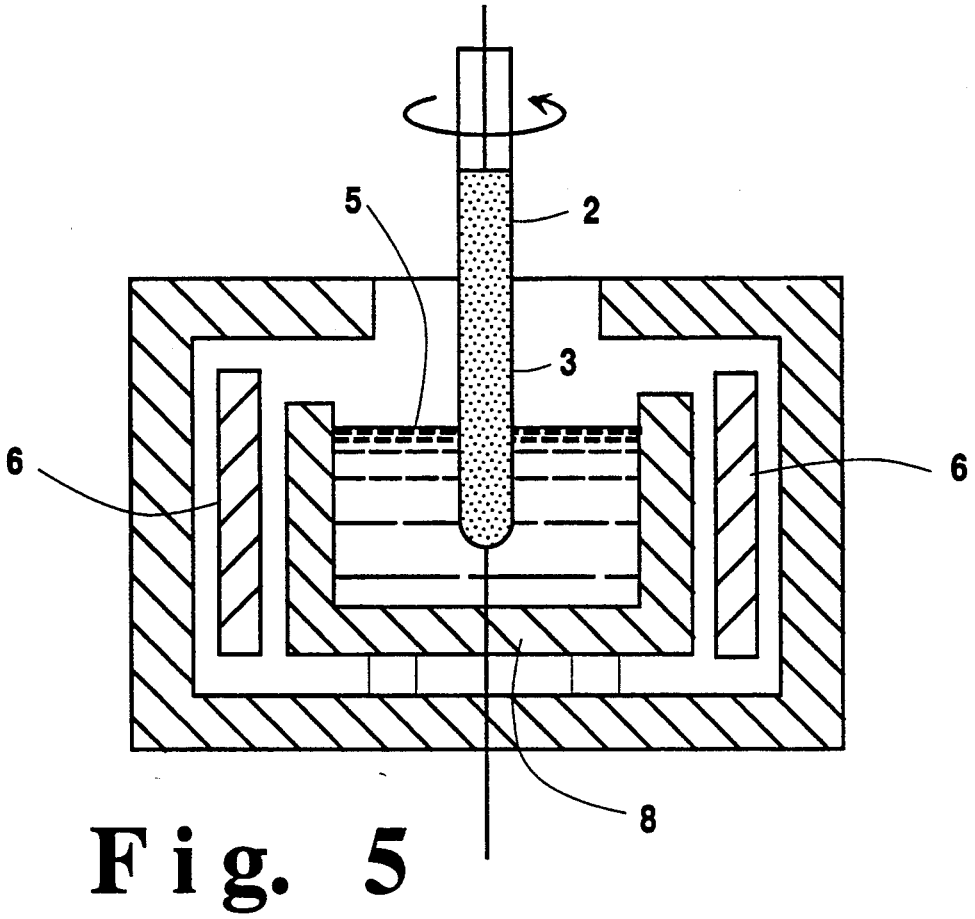
FIG. 5 schematically shows the equipment used for the molten zinc immersion test with the bar specimens.

FIG. 5 shows the cross section of a testing equipment used for a zinc immersion test and the "Embodiment 2" will be described with this figure.

The stainless steel bar-type specimen (2) with 20 mm diameter and a round edge at one end was coated with 0.12 mm thick Mo-B alloy.

The specimen was immersed in the molten zinc (5) at 470° C. for ten days. The molten zinc (5) was heated by the heater (6) and kept in the graphite pot (8) installed in the furnace (7).

Very thin film of zinc adhered on the surface of the specimen (2) when it was taken out, but was easily removed and no change in the appearance was observed after removing the zinc film at a portion of the specimen where molten zinc had contacted, while slight oxidation was proved at the portion which had been exposed in the air over the pot during the test. Table 1 indicates the results of the test as compared to the following prior technology.

EXAMPLE 2 FOR COMPARISON

In accordance with the procedure described in the "Embodiment 2" the same test was conducted for the bar type specimen (2) coated with pure molybdenum thermally sprayed by plasma praying process. The specimen was covered with a very thick zinc film after the test and the film could not be removed. The results are shown in Table 1.

EXAMPLE 3 FOR COMPARISON

In accordance with the procedure described in the "Embodiment 2", the same test was conducted for the bar type specimen (2) coated with pure metal molybdenum by the plasma process.

The specimen was covered with a very thick zinc film after 100 hours of the test and the film could not be removed. The results are shown in Table 1.

EMBODIMENT-3

Hardness tests and wear tests were conducted on the coating of the invention. FIG. 6 shows a schematic of Ring-on-Disc type wear test.

(1) Hardness Test Hardness of the cross section of the coating was measured by Vickers hardness tester at room temperature with impingement load 300 g. and the results are shown in Table 2. High temperature hardness of the coating was also evaluated and the results are shown in Table 2.

(2) Wear Test As shown in FIG. 6, the S45C (Carbon Steel) made ring (10) with inside diameter 24 mm and outside diameter 25.Bmm was placed on the coated surface and the surface of the disc (3) was rotating to allow direction with load of 5 Kgf (blank allow). The test was conducted at room temperature in air and total sliding length was 9800 m (420 minutes, 300 rpm). The surface of the ring and the disc tested had been finished to 0.4 umRa and 0.5 umRa, respectively.

The results are shown in Table 3 and the wear is evaluated as "relative wear rate" which is calculated as follows.

Relative Wear Rate=Worn volume($mm^3$)/(Total Sliding Length(mm)×Load(Kg))

EXAMPLE 4 FOR COMPARISON

Hardness of SUS304 steel was measured at room temperature as well as at elevated temperatures (500° C. and 700° C.) by the same method used for Embodiment 3.

The results are shown in Table 2.

Wear test was also conducted for SUS304 steel with the same method described in Embodiment 3 except that SUS304 steel was used for the disc specimen. The results are shown in Table 3.

As described above, the article related to the invention has a Mo-B alloy coating, comprising 3 to 9 wt % or favorably 6–8 wt % boron and the balance molybdenum and the coating is formed by detonation, high speed gas flame and plasma processes. By detonation process, a coated layer with less than 1% porosity is possible.

A part of boron exists in the form of MoB or $Mo_2B$ in the thermal sprayed coating obtained by the present invention. Since these are precipitated in the molybdenum matrix as inter-metallic compounds, the coating has high hardness.

It is effective to apply the coating of this invention to the articles which require wear and corrosion resistance characteristics at the same time such as a bearing, a sleeve and a barrel surface of a pot roll used in a plating line and a plating hunger.

TABLE 1

| Results of Immersion Test | | | | |
|---|---|---|---|---|
| Sample | Base Metal | Coating Material | Duration Immersed | Conditions After Test |
| 1 | 403 Stainless Steel | Mo-7.7B | 500 Hr. | Thin zinc film adhered but easily removed |
| 2 | 403 Stainless Steel | Mo-6.6B | 1000 Hr. | Thin zinc film adhered but easily removed |
| 3 | 403 Stainless Steel | WC-Co | 240 Hr. | Thick zinc film adhered and could not be removed |
| 4 | 403 Stainless Steel | Mo | 100 Hr. | Thick zinc film adhered and could not be removed |

TABLE 2

| Hardness | | | | | | | | |
|---|---|---|---|---|---|---|---|---|
| | Composition wt. % | | | | Porosity | Hardness | | |
| Specimen | Mo | MoB | $Mo_2B$ | Boron % | % | Room Temp. | 500 C. | 700 C. |
| 1 | 22.6 | 77.4 | — | 7.7 | 1.0 | 1334 | | |
| 2 | 33.2 | 60.7 | 6.1 | 6.4 | 0.75 | 1120 | 1051 | 1012 |
| 3 | 40.2 | 52.1 | 7.7 | 5.9 | 0.5 | 1160 | | |
| 4 | 54.5 | 37.0 | 8.5 | 4.1 | 0.4 | 1107 | | |
| 5 | SUS 304 | | | — | — | 240 | 115 | 110 |

TABLE 3

| Result of Wear Test | | | | |
|---|---|---|---|---|
| | | Relative Wear Rate mm2/Kg | | |
| Specimen | Composition | Disc Sample | Ring | Coefficient of Friction |
| 1 | Mo-6. 4B | less than $0.1 \times 10-7$ | less than $0.1 \times 10-7$ | 0.40 |
| 2 | SUS 304 | $3.5 \times 10-7$ | $11.7 \times 10-7$ | 0.65 |

We claim:

1. An article resistant to attack by molten zinc comprising a substrate having a coated layer on its surface consisting essentially of a Mo-B alloy containing 3 to 9 weight percent boron and the balance molybdenum with impurities.

2. The article of claim 1 in which at least a part of said boron exists as the form of MoB, $Mo_2B$ or MoB and $Mo_2B$.

3. The article of claim 1 in which said coated layer is sealed with a non organic sealing material.

4. The article of claim 3 wherein the sealing material is selected from the group consisting of water glass and colloidal silica.

* * * * *